US006896341B2

(12) United States Patent
Cattoire

(10) Patent No.: US 6,896,341 B2
(45) Date of Patent: May 24, 2005

(54) STORAGE ASSEMBLY WITH ADAPTABLE DOUBLE HANGING CLOSET

(75) Inventor: Michel Cattoire, Saint Jean de Luz (FR)

(73) Assignee: Sogal France, Paris (FR)

( * ) Notice: Subject to any disclaimer, the term of this patent is extended or adjusted under 35 U.S.C. 154(b) by 159 days.

(21) Appl. No.: 10/203,040

(22) PCT Filed: Feb. 21, 2001

(86) PCT No.: PCT/FR01/00501

§ 371 (c)(1),
(2), (4) Date: Oct. 18, 2002

(87) PCT Pub. No.: WO01/80688

PCT Pub. Date: Nov. 1, 2001

(65) Prior Publication Data

US 2003/0090178 A1 May 15, 2003

(30) Foreign Application Priority Data

Apr. 25, 2000 (FR) ..... 00 05551

(51) Int. Cl.[7] ..... A47B 45/00
(52) U.S. Cl. ..... 312/205
(58) Field of Search ..... 312/205, 237, 312/240, 257.1, 273, 351; 211/175, 204, 206

(56) References Cited

U.S. PATENT DOCUMENTS

| | | | | | |
|---|---|---|---|---|---|
| 842,821 | A | * | 1/1907 | Tryon | 312/205 |
| 1,161,934 | A | * | 11/1915 | Gilmore | 312/205 |
| 2,885,090 | A | * | 5/1959 | Forman et al. | 211/175 |
| 5,865,517 | A | * | 2/1999 | Wang | 312/237 |

FOREIGN PATENT DOCUMENTS

| | | | | |
|---|---|---|---|---|
| DE | 2435024 | * | 2/1976 | |
| DE | 9011488 | * | 1/1991 | |
| FR | 2703226 | * | 10/1994 | 312/205 |
| FR | 2742639 | * | 6/1997 | |
| GB | 10437 | * | 5/1899 | 312/205 |

* cited by examiner

*Primary Examiner*—James O. Hansen
(74) *Attorney, Agent, or Firm*—Oliff & Berridge, PLC

(57) ABSTRACT

The storage assembly with an expandable double hanging closet includes: at least two lower horizontal bars forming a shoe-holder; at least an intermediate horizontal hanging closet bar, arranged substantially midway between the upper bar and the lower bars to hang short garments; and a vertical and mobile partition, whereof the lower part is mounted sliding on the lower bars and the upper part is integral with one of the ends of the intermediate hanging closet bar, the other end of the intermediate wardrobe bar being mounted slidably in the vertical post separating the two compartments, respectively, the linen closet and the hanging closet.

6 Claims, 2 Drawing Sheets

STORAGE ASSEMBLY WITH ADAPTABLE DOUBLE HANGING CLOSET

BACKGROUND

The invention relates to a storage assembly and more particularly concerns assemblies comprising a linen compartment with shelves and/or drawers and a hanging closet compartment.

Depending on the embodiment, the hanging closet compartment comprises:

- either a single horizontal bar in the upper part for hanging long garments such as overcoats or raincoats,
- or two superposed horizontal bars, one in the upper part and the other approximately halfway down, each of these bars being able to take short garments such as jackets or the like.

Whether the bars of the hanging closet are fixed permanently or detachably between the two uprights of the hanging closet compartment, the user of this compartment must choose, either when purchasing or when erecting the assembly, between the two configurations. If he opts for two superposed hanging closet bars, the user gains in storage capacity, but has to put his long garments, such as his raincoat, elsewhere. If he opts for a single hanging closet bar he can store his long garments, but loses 50% of the height of the hanging closet.

Once the decision is made, it is practically definitive because, even if the bars can be taken out, removing the lower bar, for example to store a long garment, reduces the storage capacity by half and is out of the question unless the user has other means of storage.

SUMMARY

It is an object of the present invention to solve this problem by providing a storage assembly with an adjustable double hanging closet that can be adapted to the storage requirements of the user, without too great a reduction in the hanging garment storage capacity.

For this purpose, the storage assembly according to the invention comprises:

- at least two lower horizontal bars forming shoe-holders,
- at least one intermediate horizontal hanging closet bar arranged substantially midway between the upper bar and the lower bars to hang short garments,
- and a vertical and mobile partition, whereof the lower part is able to slide on the lower bars and the upper part is integral with one of the ends of the intermediate hanging closet bar, the other end of this intermediate hanging closet bar being able to slide through the vertical upright separating the linen compartment from the hanging closet compartment.

The mobile partition integral with the intermediate hanging closet bar can thus occupy a variety of positions, between a clearance position, in which said partition is against the upright separating the hanging closet compartment from the linen compartment, thus leaving this linen [sic] compartment completely free, and a position of maximum use, in which this partition is placed against the external upright of the hanging closet compartment and allows complete use of the intermediate bar for storing short garments on both hangers. In the intermediate positions, the bars can take short garments, but the upper bar can also take a number of long garments that depends on the distance left between the external upright of the hanging closet and the vertical partition, and this distance can be increased or reduced as required by the user.

This inexpensive arrangement, adjustment of which is very easy, greatly improves the storage options in a hanging closet and can be adapted to suit both the user and the season.

Depending on the particular embodiment, this arrangement can be applied to a unit with fixed compartments or to an extensible unit, for example of the type disclosed in French Patent 93 04095.

Other features and advantages will be found in the following description which refers to the appended diagrammatic drawing showing by way of example the application of the invention to an extensible storage assembly.

DETAILED DESCRIPTION OF THE EMBODIMENT

Figure 1:
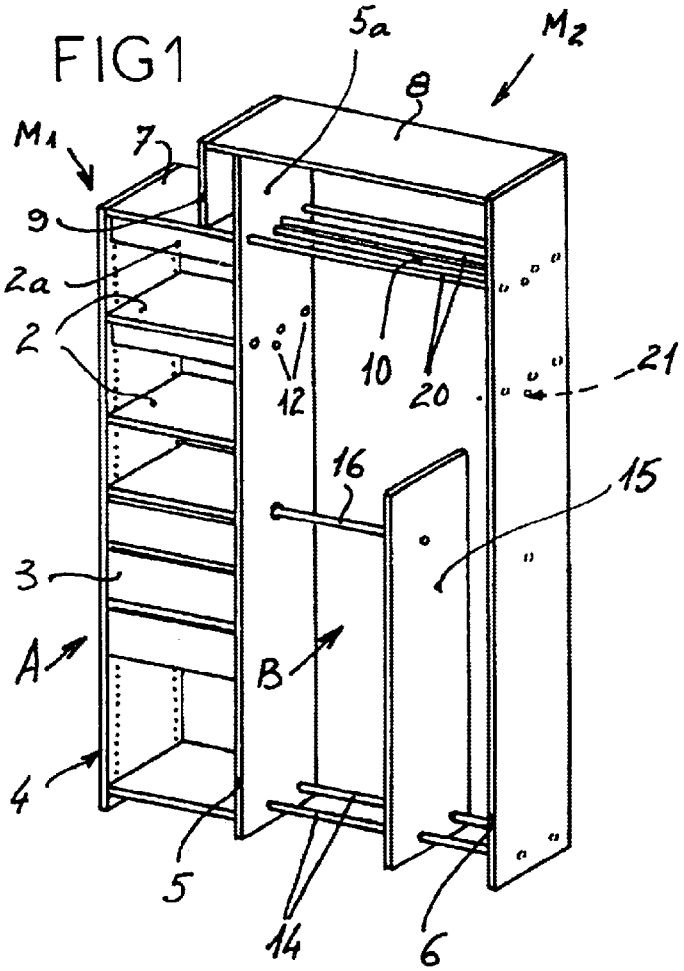
FIG. 1 is a perspective view of the storage unit.
Figure 3:
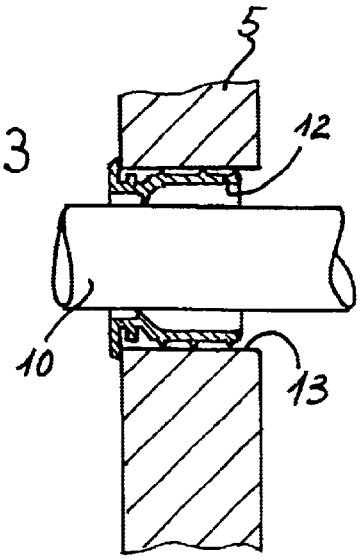
FIG. 3 is a partial part [sic] view in cross section showing on an enlarged scale an embodiment of a guide bearing for the bars.

In general terms, the storage unit is made up of two compartments, namely: a linen compartment A fitted with shelves 2 and drawers 3, and a hanging closet compartment B. These compartments are defined between an external 4, an internal 5 and an external 6 vertical uprights.

In the embodiment illustrated corresponding to an extensible storage assembly whose width can be adjusted to the gap between the two walls of a recess in the wall, the unit is made up of two independent modules, that is:

- a first module M1 in the form of a column comprising the uprights 4 and 5, the shelves 2, the drawers 3 and a horizontal top board 7,
- and a second module M2 comprising the external upright 6, a top board 8 and a vertical return 9.

Figure 2:
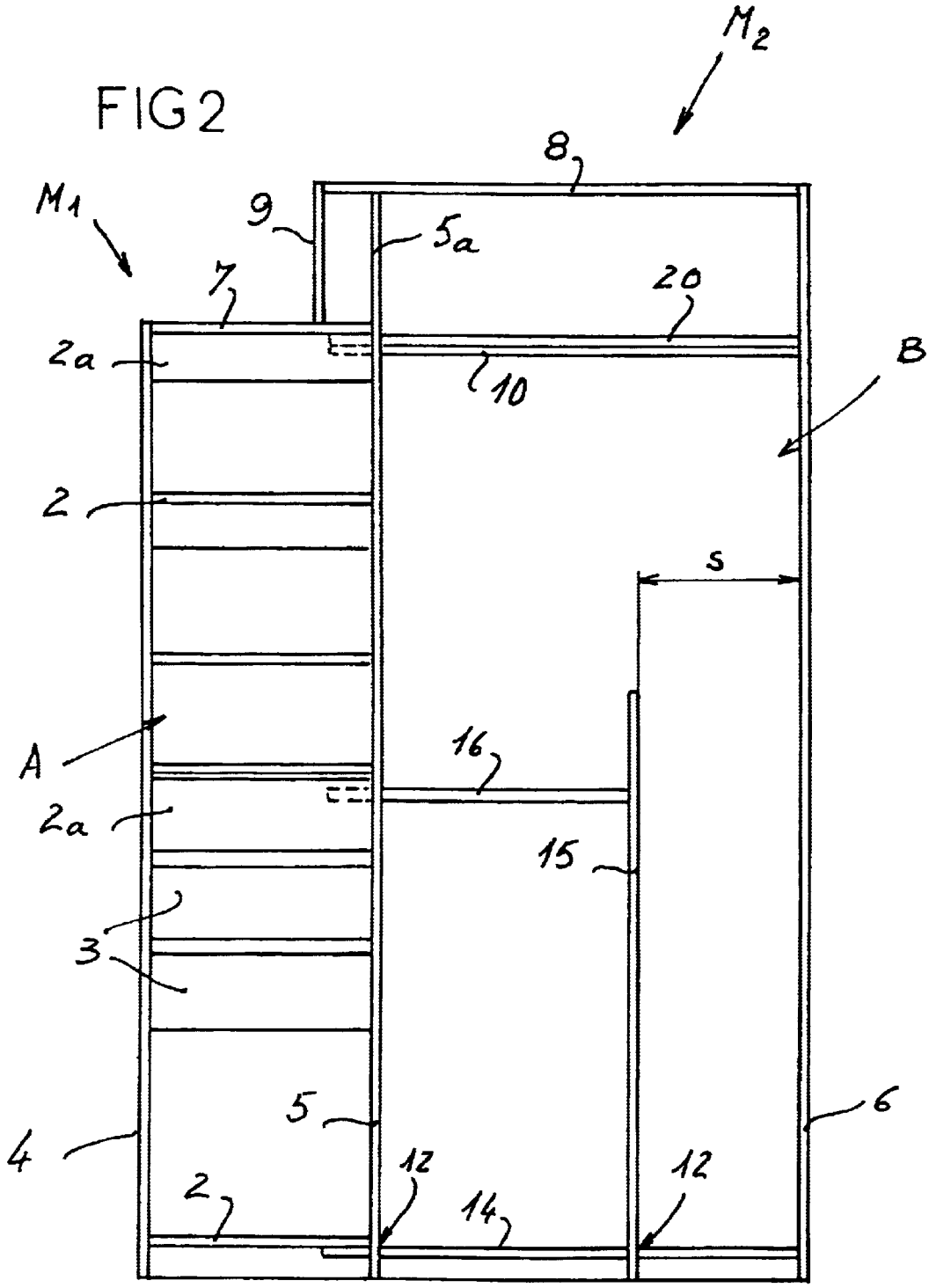
FIG. 2 is a front view with the separating partition in an intermediate position.

FIGS. 1 and 2 show clearly that the return 9 [sic] is supported on the extension 5*a* of the internal upright 5, while the return 9 is supported on the top board 7 of the first module M1.

The module M2 is equipped in the upper part with a horizontal hanging closet bar 10, of which one end is connected to the upright 6 and the other is able to slide through the upright 5, more precisely through a bearing 12 made of a synthetic material placed in a bore 13 in the wall 5.

The external upright 6 is also integral in the lower part with the ends of two horizontal bars 14 forming a shoe-holder, the ends of these bars being able to slide through the lower part of the internal upright 5, either directly or through intermediate plastic bearings 12. According to the invention, the lower part of a mobile vertical partition 15 that is not as tall as the uprights 5 and 6 is able to slide on these two bars 14.

In one embodiment, this sliding movement is speed-limited and occurs via plastic bearings 12 fitted to the mobile partition 15.

Near its upper end, the mobile partition 15 is integral with one of the ends of an intermediate hanging closet bar 16, the other end of which is able to slide at limited speed through a bearing 12 fitted to the internal upright 5.

FIGS. 1 and 2 show that the various bearings 12 fitted to the internal upright 5 for the bar 10, for the bar 16 and for the bars 14, are in a vertical arrangement such as not to coincide with the side of a drawer or with the edge of a shelf and, preferably, are arranged so as to be immediately underneath a shelf 2 and underneath the board 7.

The shelf which is close to such a bearing 12 is advantageously provided with a fascia 2*a* to conceal the projecting part of the bar 10, 16 or 14 where it passes into the linen compartment A.

It will be obvious that the bars 10, 16, 14 have a length equal to the gap between the external upright 6 and the return 9 of the module M2 and are therefore longer than the width of the hanging closet compartment B in order to be able to be supported by the internal upright 5, even when the assembly is in its position of maximum extension.

With this arrangement, the mobile partition 15 can be moved transversely between the uprights 5 and 6, to occupy various intermediate positions between two extreme positions, a clearance position in which this partition 15 is against the upright 5 and leaves the hanging closet compartment B completely free, and a position of maximum use in which the mobile partition 15 is against the inside face of the external upright 6 and forms an intermediate hanger extending across the full width of the hanging closet compartment. In this position, the upper hanger and the lower hanger can only take short garments, such as jackets.

If the user wishes to store one or more long garments in the hanging closet, he simply moves the mobile vertical partition 15 by a value S in FIG. 2 to form a compartment C that can take long garments hanging from the upper bar 10. FIG. 2 shows that, in this configuration, the storage capacity of the intermediate hanger is reduced in the same way as the storage capacity for short garments of the upper hanger, but to a lesser extent than if the entire intermediate hanger were removed.

By means of this arrangement the operator can vary the width of the compartment C according to his storage requirements, without too much affecting the storage of short garments, in order to fit in long garments.

In the embodiment illustrated, one of the hanging closet bars, for example the upper bar 10, is accompanied by several supplementary bars 20 with which it forms a shelf for duvets or blankets.

The bars 20 are, like the bar 10, fixed at one end in the upright 6 and able at their other end to slide at limited speed through bearings 12 fitted to the internal upright 5.

FIG. 1 shows that the uprights 5 and 6 comprise, between the upper bar 10 and the intermediate bar 16, bearings 12 and blind holes 21, respectively, which can be used to install another series of bars 10 and 20, for example if the storage assembly is designed to take shorter children's garments. These bars allow the upper part to be used to store duvets or blankets.

Figure 4:
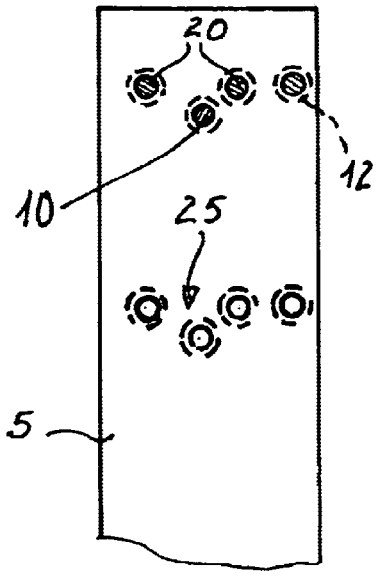
FIG. 4 is a partial side view in elevation of the upper part of the internal upright of the linen compartment.

FIG. 4 shows that when the bars are used with a hanging closet bar 10, they are arranged above the level of this bar 10 so as not to interfere with the insertion of the hooks of coathangers over this bar 10, yet forming a cavity 25 that will keep duvets or blankets in place.

This hanging closet arrangement can of course be applied to a storage assembly with two fixed compartments. In this case, only the bar 16 is able to slide through the internal upright 5, the other bars 10, 14 and 20 being connected, directly or indirectly, to the uprights 5 and 6.

What is claimed is:

1. A storage assembly with adaptable double hanging closet, comprising:

a first vertical upright, a second vertical upright and a third vertical upright which define two compartments including a linen compartment, with shelves and drawers, and a hanging closet compartment, the hanging closet compartment having at least an upper part and an upper horizontal bar disposed in the upper part to hang long garments, wherein the hanging closet compartment includes:

at least two lower horizontal bars forming shoe-holders;

at least one intermediate horizontal hanging closet bar arranged substantially midway between the upper horizontal bar and the at least two lower horizontal bars to hang short garments, wherein the at least one intermediate horizontal hanging closet bar has a first end and a second end; and a vertical and mobile partition including a lower part and an upper part, wherein the lower part is able to slide on the at least two lower horizontal bars and the upper part is integral with the first end of the at least one intermediate hanging closet bar, the second end of the at least one intermediate horizontal hanging closet bar being able to slide through the second vertical upright separating the linen compartment from the hanging closet compartment.

2. The storage assembly as claimed in claim 1, the vertical and mobile partition defines a through hole and further comprises at least one plastic bearing arranged in the through hole, wherein the at least one intermediate horizontal hanging closet bar is able to slide at a limited speed through the at least one plastic bearing.

3. The storage assembly as claimed in claim 1, the at least one intermediate horizontal hanging closet bar being positioned vertically, so as to include a part extending into the linen compartment close to an underside of one of the shelves.

4. The storage assembly as claimed in claim 1, vertical and mobile partition further comprises at least one plastic bearing, wherein the vertical and mobile partition is able to slide at limited speed on the at least two lower horizontal bars via the at least one plastic bearing.

5. The storage assembly as claimed in claim 1, wherein the upper horizontal bar and the at least two lower horizontal bars include one end and an other end and are connected at the end remote from the linen compartment, to the third vertical upright of the hanging closet compartment, and slide near the other end, the assembly further comprising:

at least one plastic bearing in the second vertical upright of the linen compartment;

a first module comprising the second vertical upright, wherein the first module is a column that includes the first vertical upright the second vertical upright, a top board, the shelves and the drawers; and a second module defining the hanging closet compartment, including the third vertical upright, wherein the third vertical upright carries the upper hanging closet bar and the at least two lower horizontal bars, and an upper horizontal panel that rests on an extension of the second vertical upright of the linen compartment.

6. The storage assembly as claimed in claim 1, further comprising several supplementary bars at horizontal that accompanies the upper horizontal bar, wherein the upper horizontal bar and the several supplementary bars forms a blanket shelf, each of the several supplementary bars connected to the third vertical upright of the hanging closet compartment and able to slide at limited speed through the second vertical upright of the linen compartment.

* * * * *